US011627803B1

(12) United States Patent
Chang

(10) Patent No.: US 11,627,803 B1
(45) Date of Patent: Apr. 18, 2023

(54) SHOE RACK

(71) Applicant: Wen-Tung Chang, Yilan (TW)

(72) Inventor: Wen-Tung Chang, Yilan (TW)

( * ) Notice: Subject to any disclaimer, the term of this patent is extended or adjusted under 35 U.S.C. 154(b) by 0 days.

(21) Appl. No.: 17/518,528

(22) Filed: Nov. 3, 2021

(51) Int. Cl.

| | |
|---|---|
| ***A47B 61/04*** | (2006.01) |
| ***A47B 57/04*** | (2006.01) |
| *A47F 7/08* | (2006.01) |
| *A47B 47/00* | (2006.01) |
| *A47B 57/54* | (2006.01) |
| *A47B 57/30* | (2006.01) |

(52) U.S. Cl.
CPC ..... *A47B 61/04* (2013.01); *A47B 57/04* (2013.01); *A47B 47/00* (2013.01); *A47B 57/30* (2013.01); *A47B 57/54* (2013.01); *A47F 7/08* (2013.01)

(58) Field of Classification Search
CPC ..... A47B 61/04; A47B 57/04; A47B 47/00; A47B 47/0083; A47B 47/021; A47B 57/06; A47B 57/30; A47B 57/54; A47F 7/08; A43D 117/00; A47L 23/20
USPC ..... 211/34, 36, 37
See application file for complete search history.

(56) References Cited

U.S. PATENT DOCUMENTS 3,022,897 A * 2/1962 Archer ..... A47F 7/08 312/133
3,115,254 A * 12/1963 Dowdall ..... A47B 57/04 108/108
3,974,917 A * 8/1976 Waxmanski ..... A47F 7/08 211/36
4,519,508 A * 5/1985 Gullett ..... A47F 1/12 211/175
4,763,796 A * 8/1988 Flum ..... A47F 1/12 211/186
5,172,816 A * 12/1992 Kline ..... A47F 7/08 211/37
D341,500 S * 11/1993 Klein ..... D6/672
5,617,959 A * 4/1997 Klein ..... A47F 7/08 211/37
5,718,441 A * 2/1998 Kern ..... B62B 3/16 211/187
D530,540 S * 10/2006 Stravitz ..... D6/675.4
10,531,735 B1 * 1/2020 Lucio ..... A47B 57/04
D912,447 S * 3/2021 Wang ..... D6/681
2009/0026161 A1 * 1/2009 Scriba ..... A47F 5/0018 211/144
2012/0000872 A1 * 1/2012 Troyner ..... A47B 47/021 211/153
2013/0075352 A1 * 3/2013 Mitten ..... B65G 1/023 211/183
2021/0059385 A1 * 3/2021 Boos ..... A47F 5/12
(Continued)

*Primary Examiner* — Devin K Barnett
(74) *Attorney, Agent, or Firm* — Bruce Stone LLP; Joseph A. Bruce

(57) ABSTRACT

A shoe rack includes a frame, at least one board, two rear connectors and two front connectors. The frame includes two lateral subframes each of which comprises at least one tilted beam. Each of the rear connectors includes a shaft rotatably connected to the board and a clip engaged with the tilted beam of one of the lateral subframes. Each of the front connectors includes a shaft rotatably connected to the board, a first clip, and a second clip located closer to the shaft than the first clip. The board extends horizontally when the first clip is engaged with the tilted beam of one of the lateral subframes. The board is tilted when the second clip is engaged with the tilted beam of one of the lateral subframes.

10 Claims, 7 Drawing Sheets

(56) References Cited

U.S. PATENT DOCUMENTS

| | | | | |
|---|---|---|---|---|
| 2021/0244179 | A1* | 8/2021 | Felsenthal | A47B 45/00 |
| 2021/0394807 | A1* | 12/2021 | Kontuniemi | B62B 3/022 |

* cited by examiner

SHOE RACK

BACKGROUND OF INVENTION

1. Field of Invention

The present invention relates to a shoe rack and, more particularly, to a shoe rack with angle-adjustable boards.

2. Related Prior Art

A shoe rack is used for store and display shoes. A typical shoe rack includes multiple boards supported on a frame installed on a floor. Each of the boards is supported on the frame at a constant angle. However, a user may like the boards to extend horizontally while another user may like the boards to be tilted. Such a typical shoe rack does not satisfy both users.

The present invention is therefore intended to obviate or at least alleviate the problems encountered in the prior art.

SUMMARY OF INVENTION

It is the primary objective of the present invention to provide a shoe rack with angle-adjustable boards.

To achieve the foregoing objective, the shoe rack includes a frame, at least one board, two rear connectors and two front connectors. The frame includes two lateral subframes each of which comprises at least one tilted beam. Each of the rear connectors includes a shaft rotatably connected to the board and a clip engaged with the tilted beam of one of the lateral subframes. Each of the front connectors includes a shaft rotatably connected to the board, a first clip, and a second clip located closer to the shaft than the first clip. The board extends horizontally when the first clip is engaged with the tilted beam of one of the lateral subframes. The board is tilted when the second clip is engaged with the tilted beam of one of the lateral subframes.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
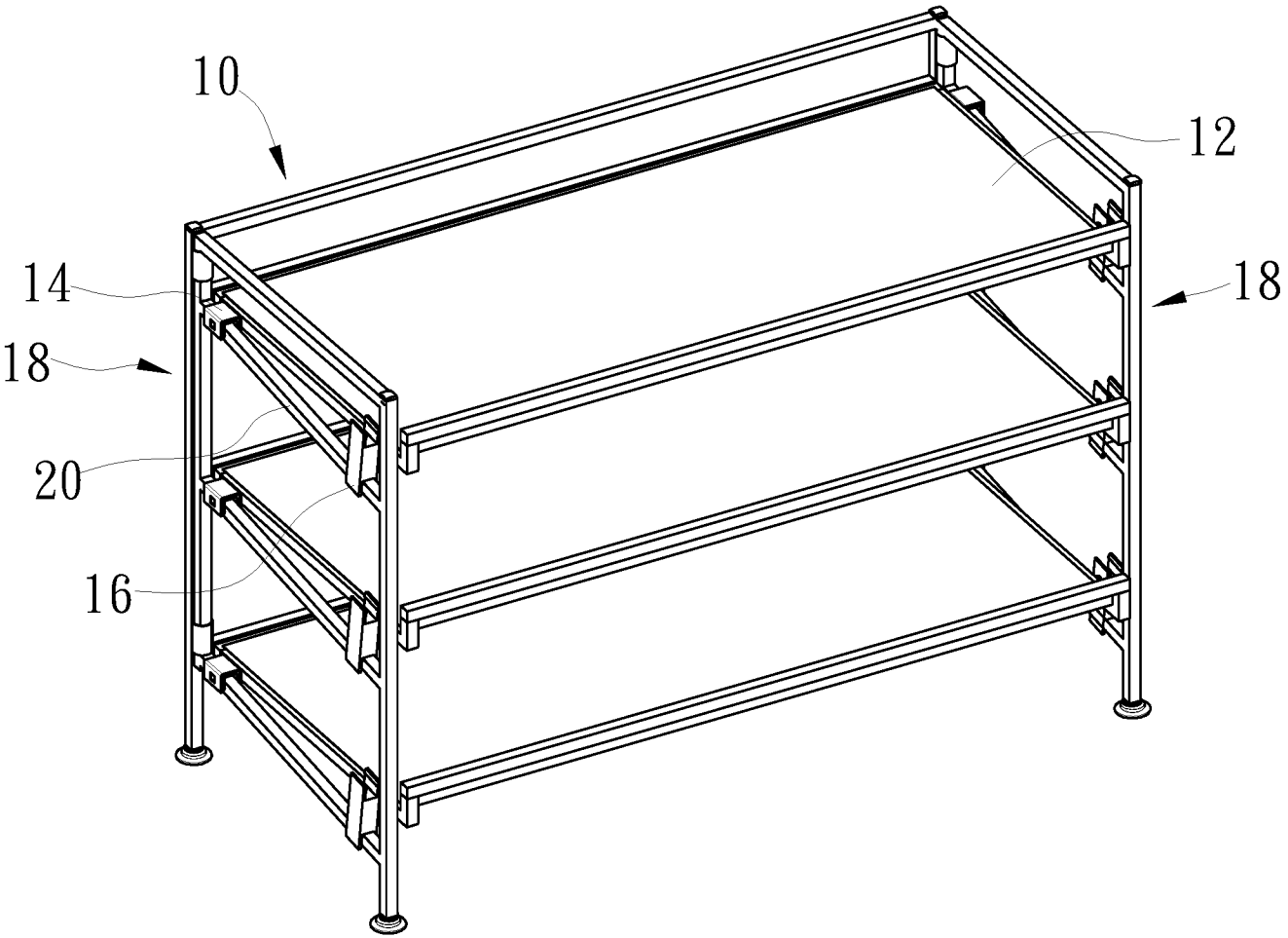
FIG. 1 is a perspective view of a shoe rack according to the preferred embodiment of the present invention.

Referring to FIG. 1, a shoe rack includes a frame 10, multiple boards 12, multiple front connectors 16 and multiple rear connectors 14 for supporting the boards 12 at one of two angles (FIGS. 3 and 6) according to the preferred embodiment of the present invention. The frame 10 includes two lateral subframes 18 being mirror images to each other. Each of the lateral subframes 18 includes multiple tilted beams 20. Each of the tilted beams 20 includes a rear end located higher than a front end. Each of the front connectors 16 and a corresponding one of the rear connectors 14 are used to support a lateral edge of a corresponding one of the boards 12 on a corresponding one of the tilted beams 20 of a corresponding one of the lateral subframes 18.

Figure 2:
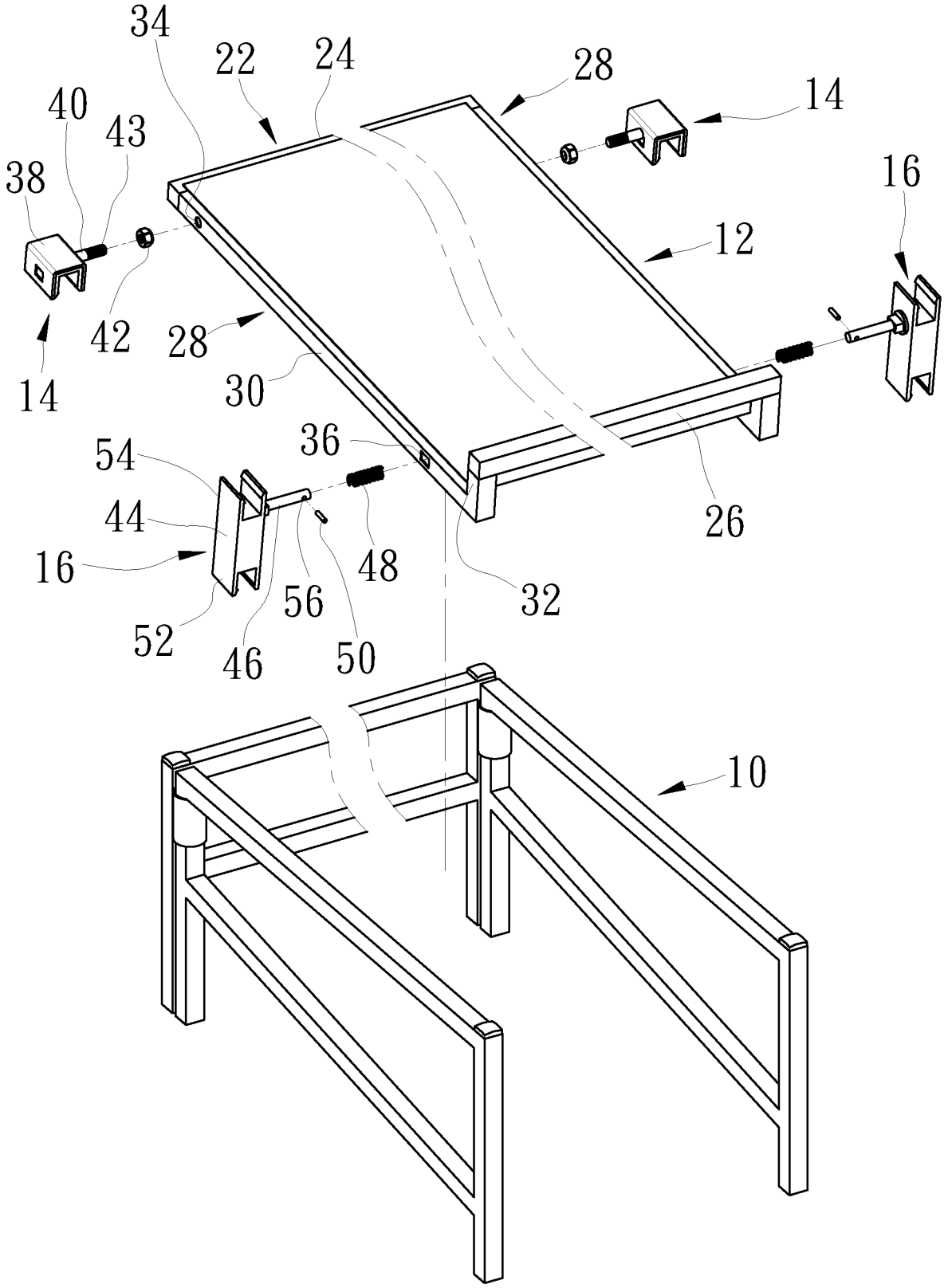
FIG. 2 is an exploded view of the shoe rack shown in FIG. 1.

Referring to FIG. 2, for clarity and briefness, the following description will be given to only one of the boards 12, one of the front connectors 16, one of the rear connectors 14 and one of the tilted beams 20 of one of the lateral subframes 18. Each edge of the board 12 is supported by a subframe 22.

The subframe 22 consists of a rear bar 24, a front bar 26 and two lateral bars 28. The rear bar 24, the front bar 26, and the lateral bars 28 are connected to one another. Each of the lateral bars 28 includes a primary section 30 and a secondary section 32. An angle of about 90 degrees exists between the primary section 30 and the secondary section 32. The primary section 30 includes a rear aperture 34 and a front aperture 36. The front and rear apertures 36 and 34 are used for the front and rear connectors 14 and 16 to be described later.

Figure 6:
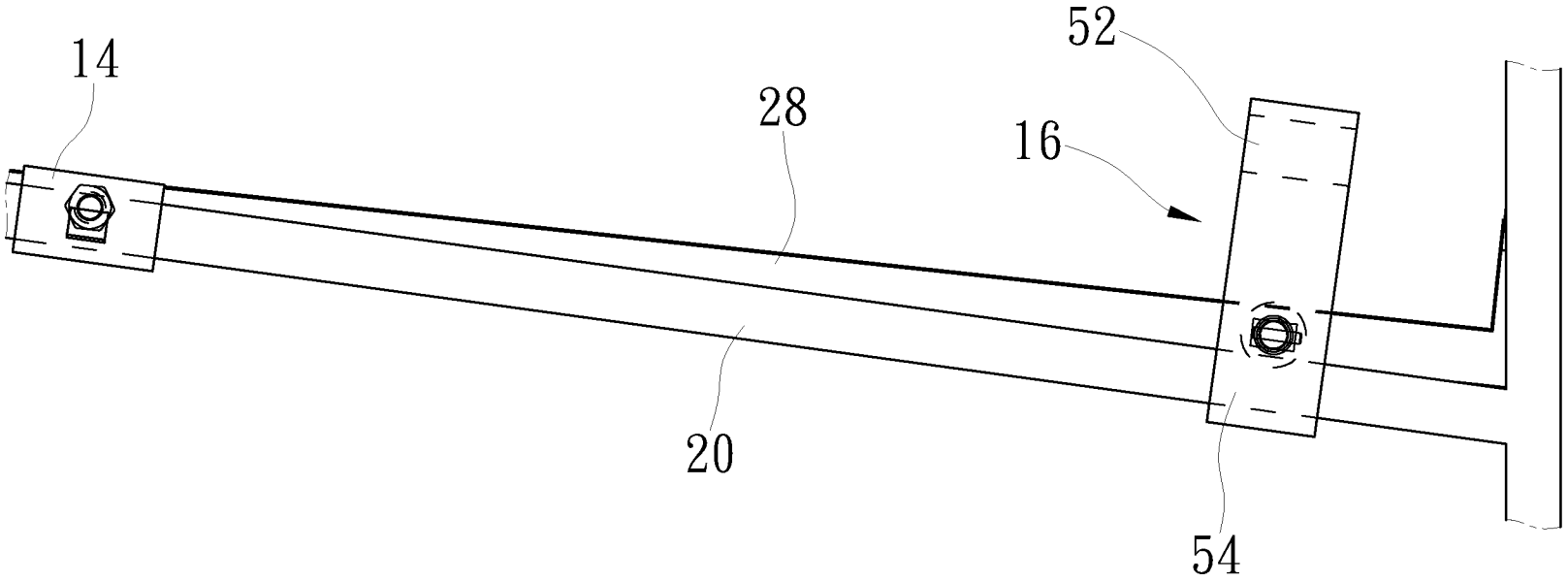
FIG. 6 is a partial and side view of the shoe rack in another position than shown in FIG. 3.

The secondary sections 32 of the lateral bars 28 are connected to the front bar 26 to form an inverted U-shaped part used as a restraint or stop of shoes. The restraint or stop is particularly useful when the board 12 is in a tilted position (FIG. 6). The front bar 26 is located in a same horizontal plane with a rear edge of the board 12 when the board 12 is in the tilted position.

In another embodiment, the front bar 26 is an inverted U-shaped bar instead of a rectilinear bar, and each of the lateral bars 28 includes only the primary section 30. Thus, the front bar 26 alone is used as restraint or stop.

The rear connector 14 includes a clip 38, a shaft rod 40 and a nut 42. The shaft 40 extends from a side of the clip 38. The shaft 40 and the clip 38 are preferably made in one piece. The shaft 40 is formed with a threaded section 43 engageable with the nut 42.

In another embodiment, the combination of the threaded section 43 with the nut 42 can be replaced with a combination of an aperture with a pin.

Figure 5:
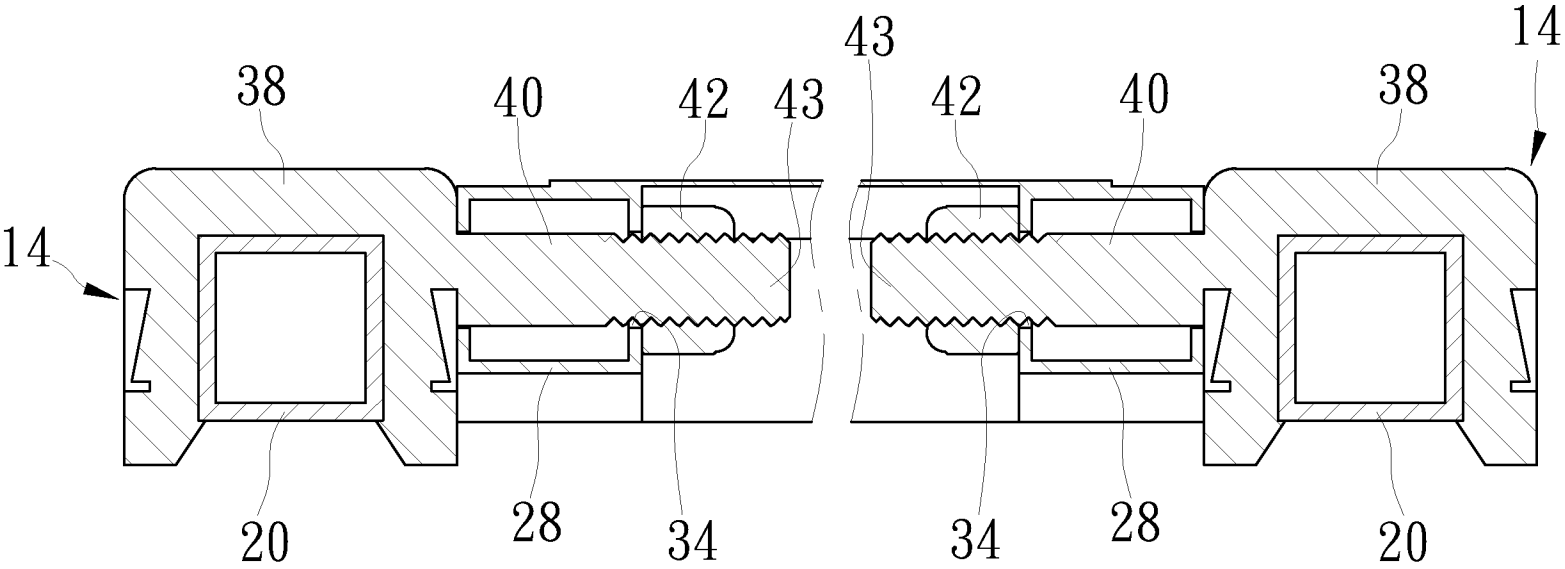
FIG. 5 is a cross-sectional view of a rear connector of the shoe rack shown in FIG. 1.

Referring to FIGS. 2 and 5, the shaft 40 extends throughout the rear aperture 34 of one of the lateral bars 28. Then, the nut 42 is engaged with the shaft 40. Thus, the rear connector 14 is rotatably connected to the lateral bar 28.

Referring to FIG. 5, in use, the clip 38 is engaged with the tilted beam 20. The rotatable connection of the rear connector 14 to the lateral bar 28 retains the engagement of the clip 38 with the tilted beam 20 no matter the lateral bar 28 is in the horizontal position shown in FIG. 3 or the tilted position shown in FIG. 6.

The front connector 16 includes an H-shaped element 44, a shaft 46, a spring 48 and a pin 50. The H-shaped element 44 includes two clips 52 and 54. Structurally, the clips 52 and 54 are identical to each other. However, the clips 52 and 54 are at different distances from the shaft 46. The shaft 46 extends from a side of the H-shaped element 44. The difference between the clip 52 and the shaft 46 is longer than the distance between the clip 54 and the shaft 46 for reasons to be given later. Hence, the clip 52 extends longer than the clip 54. The shaft 46 includes an orifice 56. Preferably, the shaft 46 and the H-shaped element 44 are made in one piece. The spring 48 is preferably a helical spring.

Figure 4:
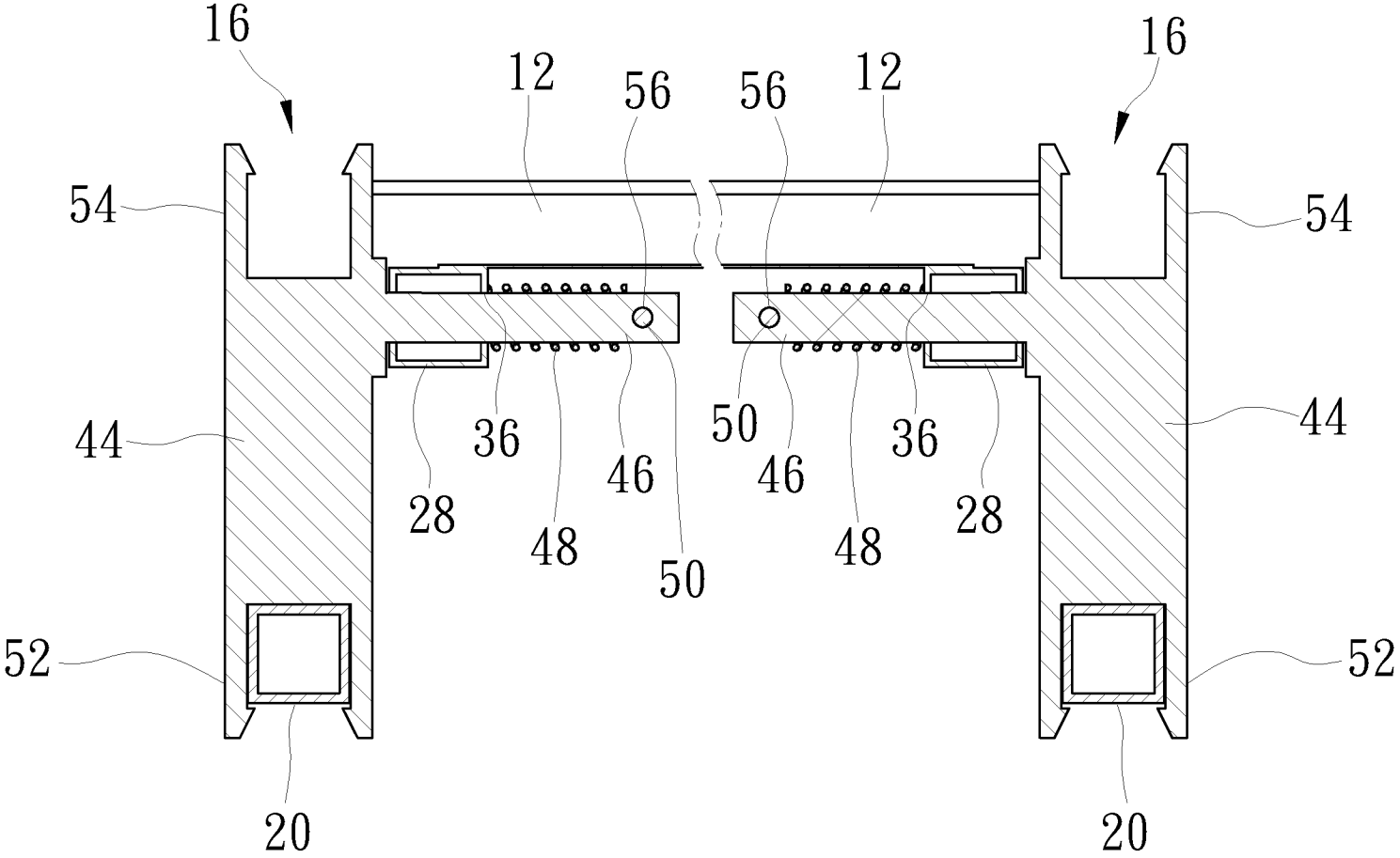
FIG. 4 is a cross-sectional view of a front connector of the shoe rack shown in FIG. 1.

Referring to FIGS. 2 and 4, the shaft 46 extends throughout the front aperture 36 of one of the lateral bars 28. Then, the shaft 46 extends throughout the spring 48. Finally, the pin 50 is fitted in the orifice 56. Thus, the front connector 16 is rotatably connected to the lateral bar 28.

Figure 3:
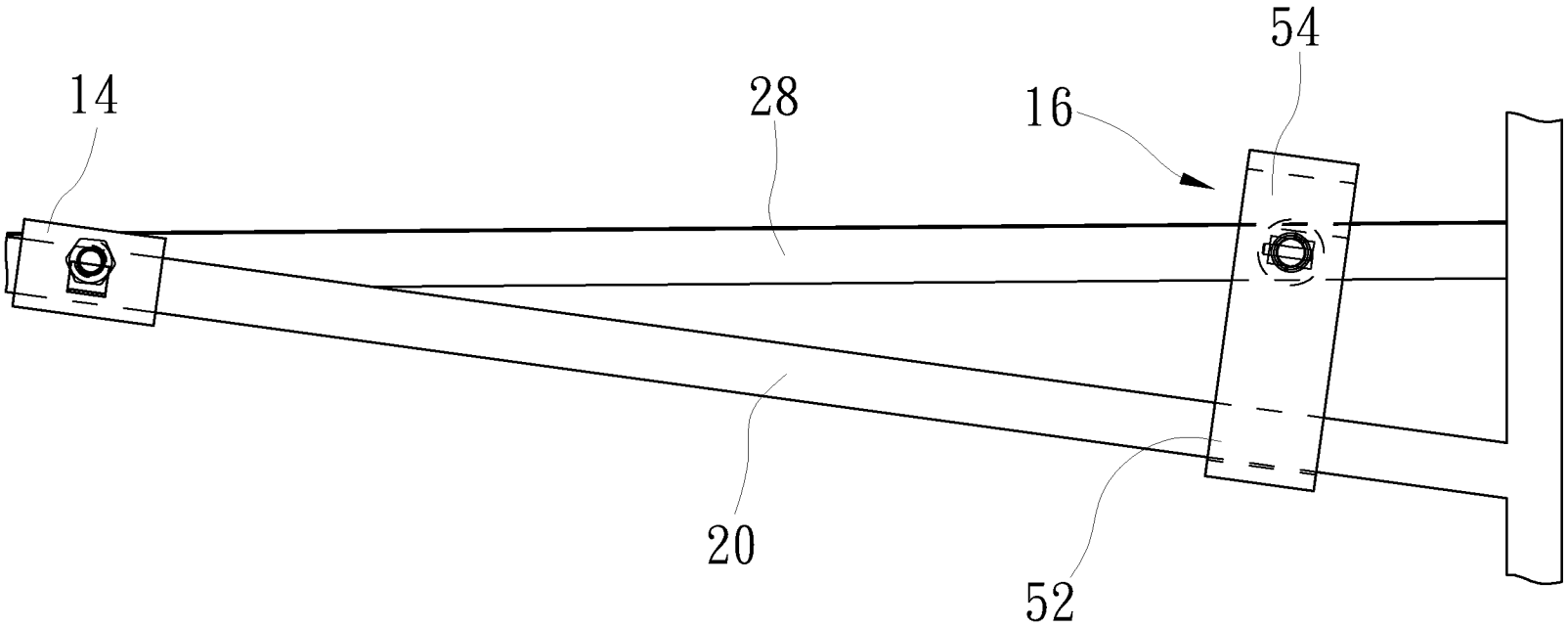
FIG. 3 is a partial and side view of the shoe rack shown in FIG. 1.

Referring to FIGS. 3 and 4, the clip 52 is engaged with the tilted beam 20. The board 12 connected to the lateral bar 28 is located horizontally because the front end of the tilted beam 20 is located lower than the lower end of the tilted beam 20 and the clip 52 extends further from the shaft 46 than the clip 54.

Figure 7:
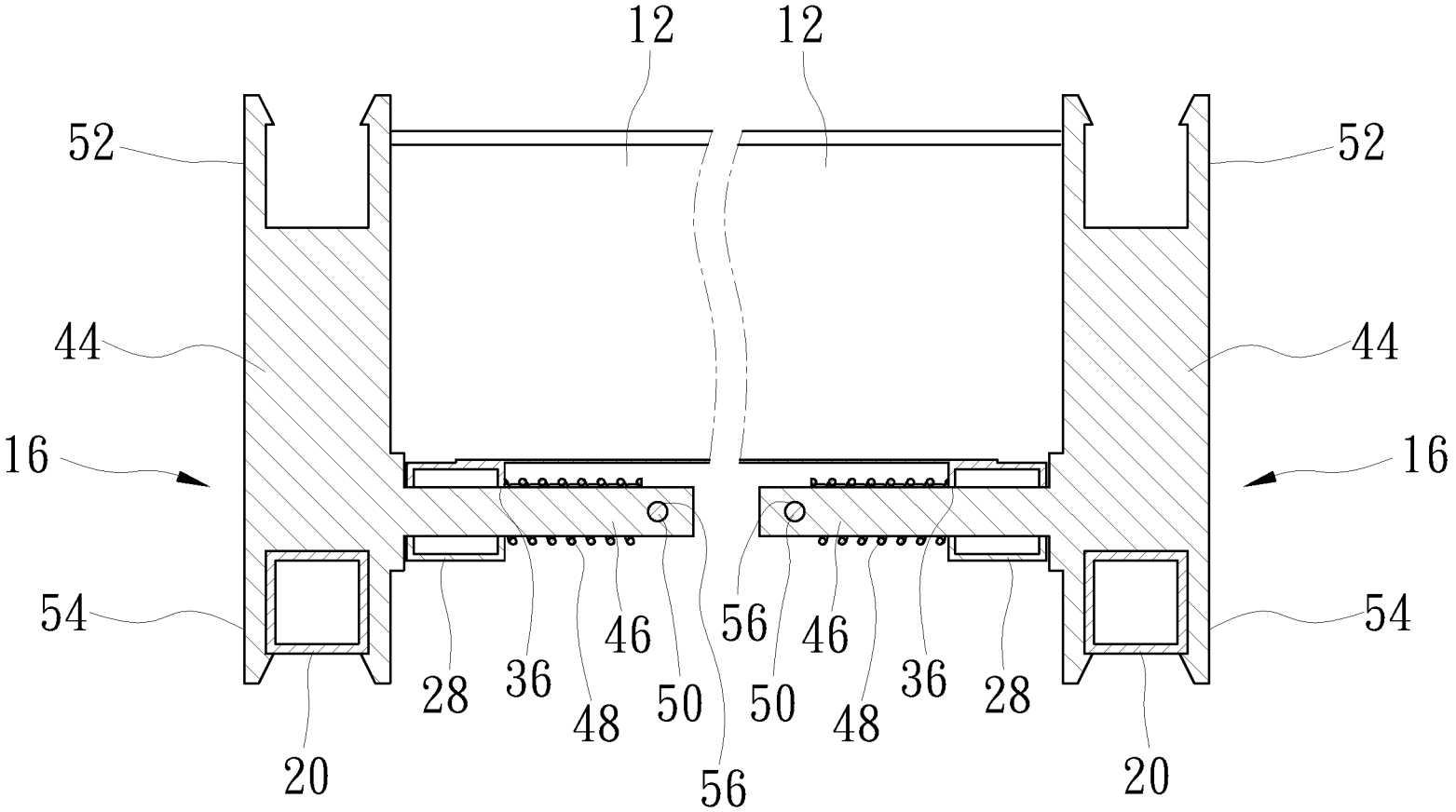
FIG. 7 is a cross-sectional view of the front connector in another position than shown in FIG. 4.

Referring to FIGS. 6 and 7, the clip 54 is engaged with the tilted beam 20. The board 12 connected to the lateral bar 28 is tilted because the front end of the tilted beam 20 is located lower than the lower end of the tilted beam 20 and the clip 54 is located closer to the shaft 46 than the clip 52.

In another embodiment, the rear connector 14 can include the orifice 56 and the pin 50 instead of the threaded section 43 and the nut 42. In such an embodiment, the rear connector 14 can include the spring 48 in addition to the orifice 56 and the pin 50.

In another embodiment, the front connector 16 can include the threaded section 43 and the nut 42 instead of the orifice 56 and the pin 50. In such an embodiment, the front connector 16 does not include any spring.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A shoe rack comprising:

a frame comprising two lateral subframes each of which comprises a tilted beam;

a board;

two lateral bars connected to the board;

two rear connectors each of which comprises a shaft that is configured to be rotatably connected to one of the lateral bars and a first clip engaged with the tilted beam of one of the lateral subframes; and two front connectors each of which comprises a shaft that is configured to be rotatably connected to one of the lateral bars, a second clip, and a third clip located closer to the shaft of each of the front connectors than the second clip, wherein the board extends horizontally when the second clip is engaged with the tilted beam of one of the lateral subframes, wherein the board is tilted when the third clip is engaged with the tilted beam of one of the lateral subframes.

2. The shoe rack according to claim 1, wherein each of the lateral bars comprises a rear aperture for receiving the shaft of one of the rear connectors, wherein each of the lateral bars comprises a front aperture for receiving the shaft of one of the front connectors.

3. The shoe rack according to claim 2, wherein the shaft of each of the rear connectors comprises a threaded section, wherein each of the rear connectors comprises a nut engaged with the threaded section.

4. The shoe rack according to claim 2, wherein the shaft of each of the rear connectors comprises an orifice, wherein each of the rear connectors comprises a pin fitted in the orifice.

5. The shoe rack according to claim 4, wherein each of the rear connectors comprises a spring compressed between the pin and the lateral bar.

6. The shoe rack according to claim 2, wherein the shaft of each of the front connectors comprises a threaded section, wherein each of the front connectors comprises a nut engaged with the threaded section.

7. The shoe rack according to claim 2, wherein the shaft of each of the front connectors comprises an orifice, wherein each of the front connectors comprises a pin fitted in the orifice.

8. The shoe rack according to claim 7, wherein each of the front connectors comprises a spring compressed between the pin and the lateral bar.

9. The shoe rack according to claim 1, comprising a front bar connected to the lateral bars, wherein the front bar comprises a middle section located higher the board.

10. The shoe rack according to claim 9, wherein a middle section of the front bar is located in a same horizontal plane with a rear edge of the board when the board is in the tilted position.

* * * * *